US006050097A

United States Patent [19]

Nelson et al.

[11] Patent Number: 6,050,097

[45] Date of Patent: Apr. 18, 2000

[54] ICE MAKING AND STORAGE SYSTEM FOR A REFRIGERATOR

[75] Inventors: Mark H. Nelson, Berrien Springs; Jim J. Pastryk, New Troy; Verne H. Myers, St. Joseph, all of Mich.; Daryl L. Harmon, Newburgh, Ind.; Andrew M. Oltman; Gregory G. Hortin, both of Evansville, Ind.; James R. Peterson, St. Joseph; Victor W Cuthbert, Sodus, both of Mich.; Steven E. Tolliver, Newburgh, Ind.

[73] Assignee: Whirlpool Corporation, Benton Harbor, Mich.

[21] Appl. No.: 09/221,770

[22] Filed: Dec. 28, 1998

[51] Int. Cl.[7] ..... F25C 5/18

[52] U.S. Cl. ..... 62/137; 62/344

[58] Field of Search ..... 62/137, 344

[56] References Cited

U.S. PATENT DOCUMENTS

| | | | |
|---|---|---|---|
| 2,785,539 | 3/1957 | Simmons et al. | 62/108.5 |
| 3,025,683 | 3/1962 | Baker et al. | 62/419 |
| 3,545,217 | 12/1970 | Linstromberg | 62/137 |
| 3,602,007 | 8/1971 | Drieci | 62/344 |
| 3,621,668 | 11/1971 | Swerbinsky | 62/137 |
| 3,635,043 | 1/1972 | Sterling | 62/137 |
| 3,747,363 | 7/1973 | Grimm | 62/377 |
| 4,084,725 | 4/1978 | Buchser | 221/75 |
| 4,100,761 | 7/1978 | Linstromberg et al. | 62/137 |
| 4,176,527 | 12/1979 | Linstromberg et al. | 62/320 |
| 4,649,717 | 3/1987 | Tate, Jr. et al. | 62/240 |
| 4,756,165 | 7/1988 | Chestnut et al. | 62/135 |
| 4,942,979 | 7/1990 | Linstromberg et al. | 221/75 |
| 4,970,871 | 11/1990 | Rudick | 62/187 |
| 5,033,273 | 7/1991 | Buchser et al. | 62/344 |
| 5,050,777 | 9/1991 | Buchser | 222/146 |
| 5,160,094 | 11/1992 | Willis et al. | 62/137 |
| 5,187,950 | 2/1993 | Weldon | 62/449 |

*Primary Examiner*—William E. Tapolcal
*Attorney, Agent, or Firm*—Stephen D. Krefman; Joel M. Van Winkle; Robert O. Rice

[57] ABSTRACT

A refrigerator having a cabinet which defines a freezer compartment having an access opening and a closure member for closing the access opening. An ice maker is disposed within the freezer compartment for forming ice pieces. An ice storage bin is mounted to the closure member below the ice maker for receiving ice from the ice maker. An ice level sensing finger extends from the ice maker into the ice storage bin for sensing the level of ice within the storage bin. A lever is pivotably connected to the ice maker and biased toward the closure member for lifting the ice level sensing finger out of the ice storage bin when the closure member is opened. The lever further operates to prevent the dispensing of ice pieces when the closure member is open.

23 Claims, 9 Drawing Sheets

ICE MAKING AND STORAGE SYSTEM FOR A REFRIGERATOR

BACKGROUND OF THE INVENTION

1. Field of the Invention

The invention relates to an ice making system for a refrigerator and more particularly to an ice making and storage system in a freezer compartment of a refrigerator wherein an ice storage bin is mounted to a refrigerator closure member or door.

2. Description of Related Art

Automatic ice making systems for use in a home refrigerator are well known. Typically, ice making systems include an ice maker mounted within the freezer compartment of the refrigerator and an ice storage receptacle or bin supported beneath the ice maker for receiving the formed ice from the ice maker. The ice maker is commonly mounted within the freezer compartment adjacent the side or rear wall of the freezer compartment such that water and power can be readily supplied to the ice maker. The ice storage receptacle is supported by a shelf structure beneath the ice maker within the freezer compartment. The ice storage receptacle generally extends across the freezer compartment and has a front end adjacent the freezer door. U.S. Pat. No. 4,942,979, to Linstromberg et al. is an example of a prior art ice making system.

In the design of ice maker systems for refrigerators, it is recognized that a means must be provided for sensing the level of ice disposed in the ice storage bin such that ice pieces are produced when insufficient ice is in the storage bin and ice pieces are not produced when the ice storage bin is filled. U.S. Pat. No. 5,160,094, to Willis et al., discloses an ice making system having an ice maker which employs a bail arm which is periodically raised out of the ice storage bin and lowered back into the ice storage bin. If the presence of ice pieces interferes with the bail arm being lowered into the ice storage bin, the ice maker is deenergized such that more ice pieces are not produced.

As can be seen in all of the above mentioned patent references, one aspect of a conventional ice making and dispensing systems is that they occupy a relatively large amount of freezer shelf space. In particular, the ice storage bin extends across the freezer compartment and occupies a large amount of freezer compartment space. This is perceived as a disadvantage by many consumers who generally prefer to have more available shelf space. Accordingly, it would be an improvement to provide an ice making system which occupied less freezer shelf space. In particular, it would be an improvement in the art to provide an ice maker having an ice storage bin which is mounted on the freezer door rather than on a shelf type support in the freezer compartment.

SUMMARY OF THE INVENTION

Accordingly, the present invention is directed to a refrigerator having a cabinet which defines a freezer compartment having an access opening and a closure member for closing the access opening. An ice maker is disposed within the freezer compartment for forming ice pieces. An ice storage bin is mounted to the closure member below the ice maker for receiving ice from the ice maker. An ice level sensing finger extends from the ice maker into the ice storage bin for sensing the level of ice within the storage bin. A lever is pivotably connected to the ice maker and biased toward the closure member for lifting the ice level sensing finger out of the ice storage bin when the closure member is opened.

In one embodiment, the level sensing finger is rotatably supported from the ice maker and extends into the ice storage bin. The lever is a wire bin lever rotatably mounted to the ice maker adjacent the ice level sensing finger. The bin lever has an end contacting the ice storage bin when the closure member is closed. The bin lever is biased toward the ice storage bin such that when the closure member is opened, the bin lever rotates and contacts the ice level sensing finger to raise the end of the finger out of the ice storage bin. A front cover is rotatably supported in front of the ice maker wherein the bin lever rotates to engage the front cover when the closure member is opened.

In another embodiment, the ice level sensing finger is slidably supported from the ice maker and extends into the ice storage bin. The lever is a ramp rotatably mounted to the ice maker adjacent the ice storage bin. The ramp is biased to rotate toward the ice storage bin such that when the closure member is opened the ramp rotates and contacts the ice level sensing finger to raise the end of the finger out of the ice storage bin. A front cover is mounted in front of the ice maker wherein the ramp rotates to engage the front cover when the closure member is opened.

DESCRIPTION OF THE PREFERRED EMBODIMENTS

Figure 1:
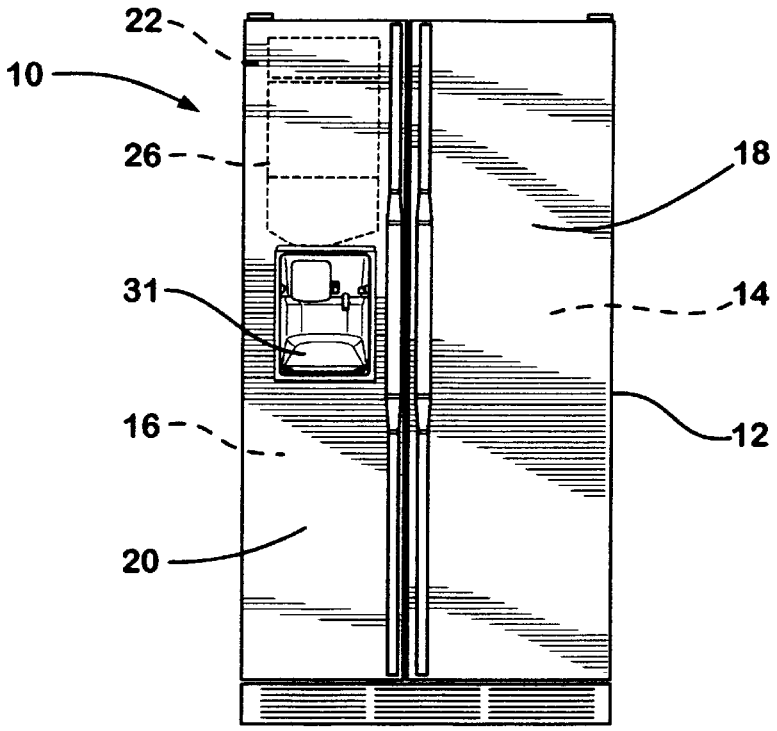
FIG. 1 is a front view of a refrigerator apparatus having an ice storing and dispensing system embodying the present invention.
Figure 2:
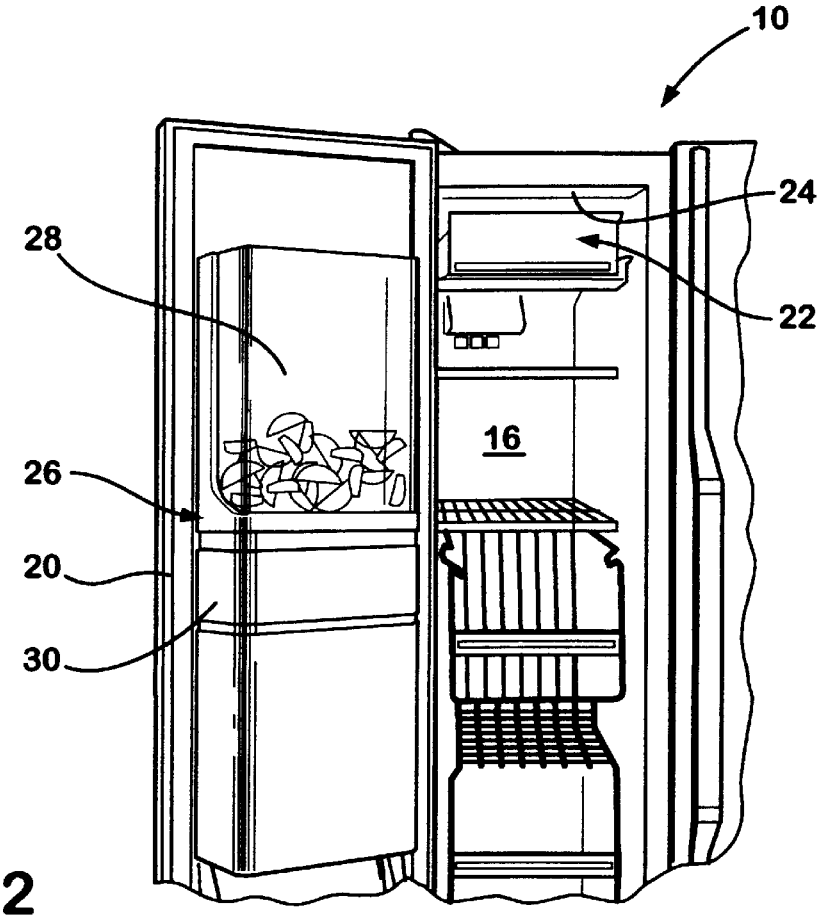
FIG. 2 is a fragmentary perspective view illustrating the ice storing and dispensing system within the freezer compartment of the refrigerator apparatus with the freezer door open.
Figure 3:
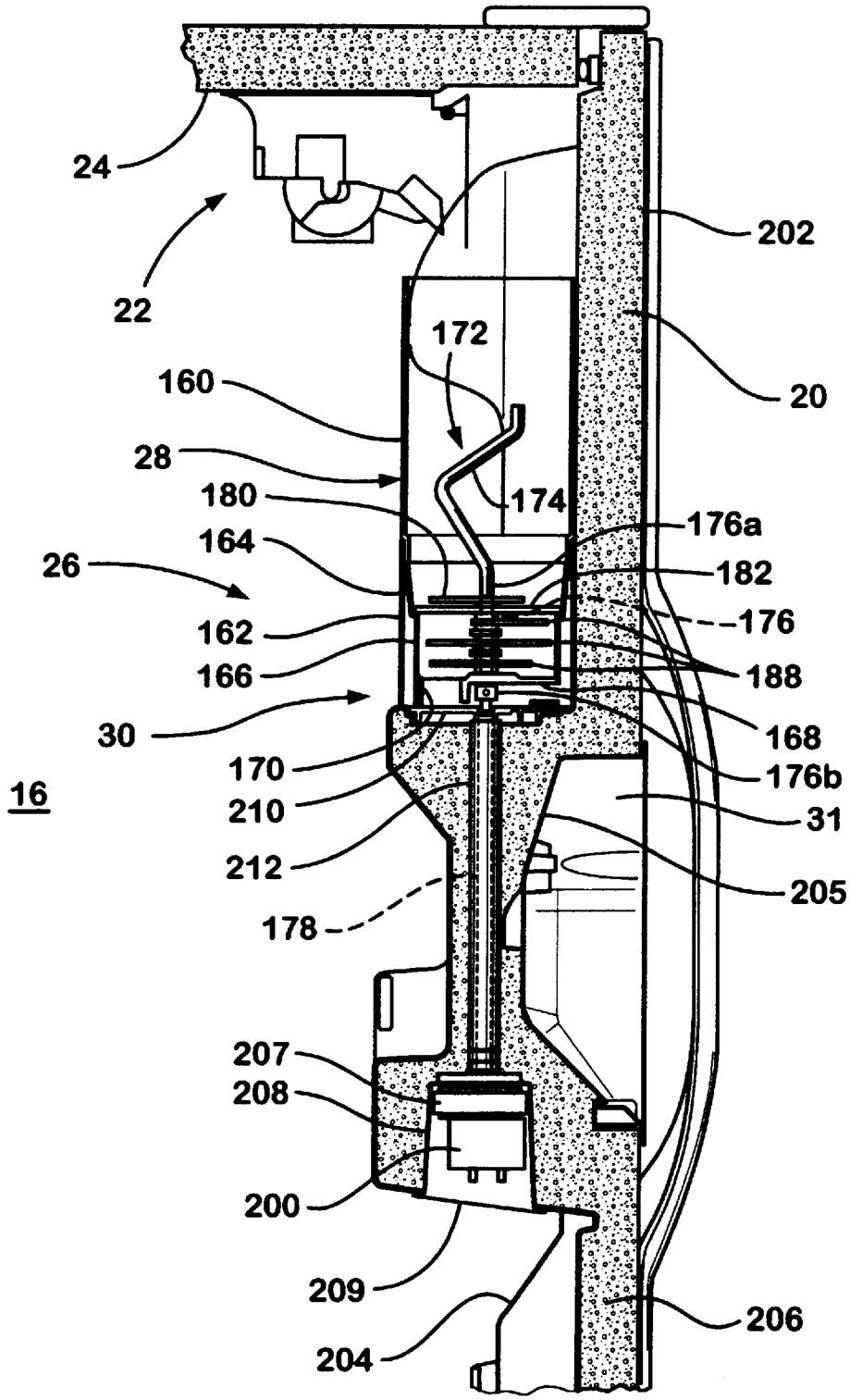
FIG. 3 is a fragmentary, side sectional view of the ice storing and dispensing system of FIG. 1.

In the illustrative embodiment of the invention as shown in FIGS. 1–3, a refrigerator 10, comprising a side-by-side fresh food/freezer configuration, is provided having a cabinet 12 forming an above freezing fresh food compartment 14 and a below freezing freezer compartment 16. Both the fresh food compartment 14 and the freezer compartment 16 are provided with access openings. A fresh food closure member or door 18 and a freezer closure member or door 20 are hingedly mounted to the cabinet 12 for closing the access openings, as is well known.

An ice making assembly 22 is disposed within the freezer compartment 16. The ice making assembly 22 is mounted to the inside surface of the top wall 24 of the freezer compartment 16. An ice dispensing system 26, mounted to the freezer door 20, is provided below the ice making assembly 22 for receiving ice pieces therefrom. The ice dispensing system 26 includes an ice storage receptacle or bin 28 having an ice crushing system 30. When operated, the ice dispensing system 26 transfers ice pieces from the bin 28 through the freezer door 20 whereby ice pieces may be dispensed through a conventional, forwardly exposed ice dispenser station or external ice service area 31.

Figure 4:
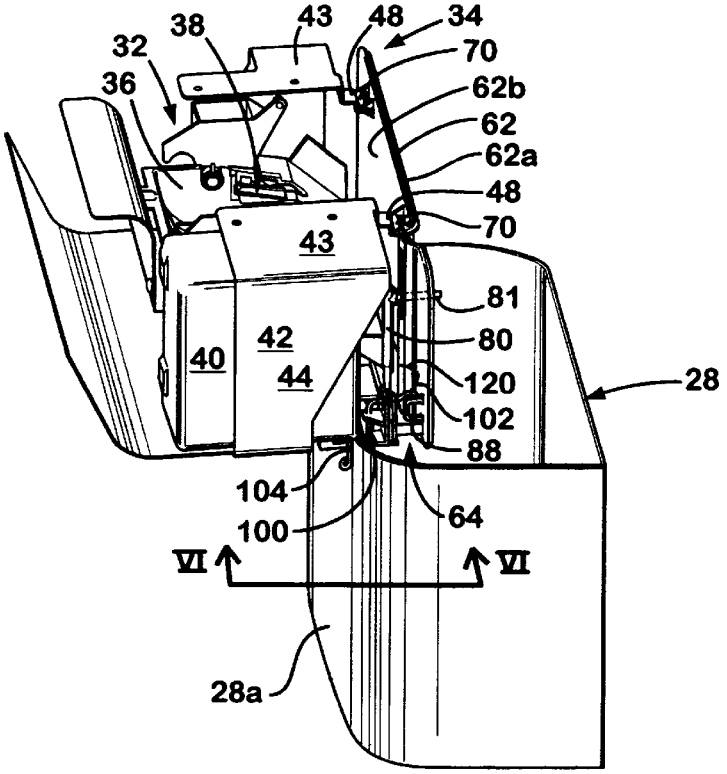
FIG. 4 is a fragmentary, perspective view of a first embodiment of the ice storage and dispensing system of the present invention.
Figure 5:
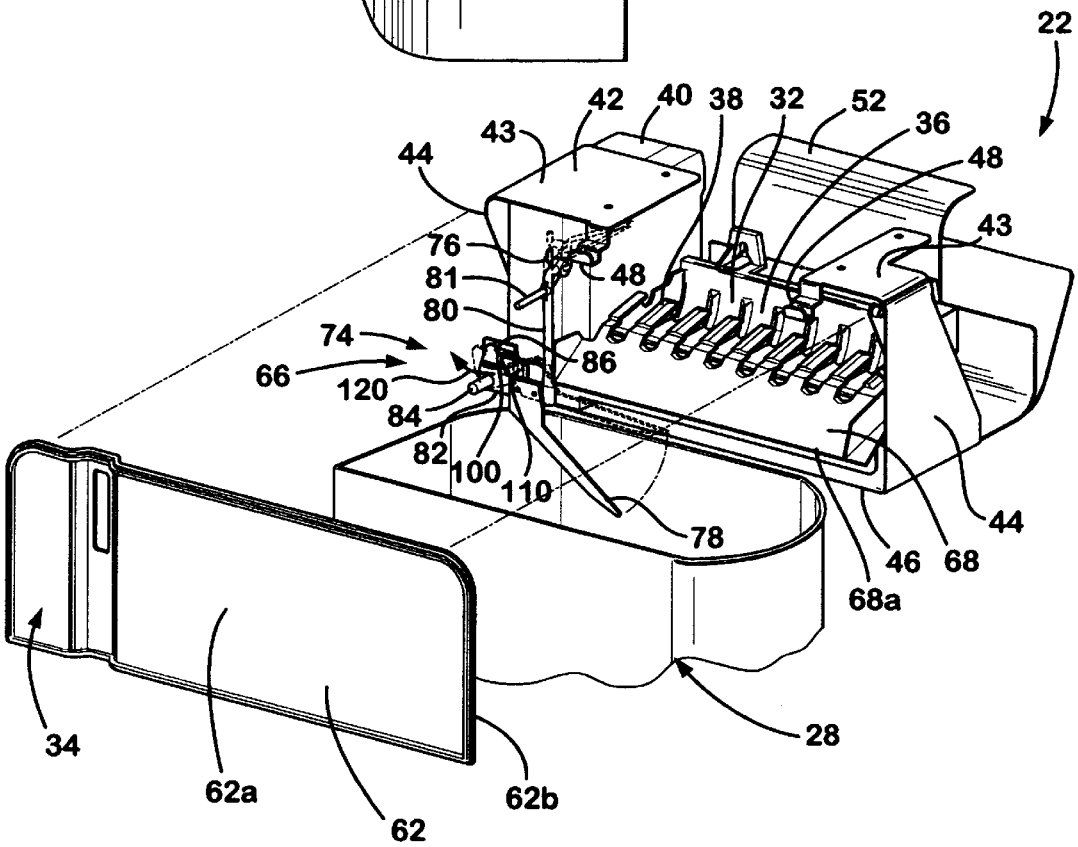
FIG. 5 is a fragmentary, perspective view of the first embodiment of the ice storage and dispensing system of the present invention wherein the front cover of the ice maker has been removed.

A first embodiment of the ice making assembly 22 can be described in greater detail by referring now to FIGS. 4 and 5. The ice maker assembly 22 generally comprises an ice maker 32 and an ice discharge assembly 34. The ice maker 32 is a conventional ice piece making apparatus which forms crescent shaped ice pieces. The ice maker 32 includes an ice mold body 36, an ice stripper 38, a rotatable ejector (not shown) and a control module 40. The control module surrounds a control motor 356 (FIG. 12) and gearing system (not shown) which operate to rotate the ejector when ice harvesting is necessary. The ice maker disclosed in U.S. Pat. No. 4,649,717, herein incorporated by reference, is illustrative of the type of ice maker used in the present invention.

The ice maker 32 is supported by a mounting bracket 42 along the upper, front portion of the freezer compartment 16. The mounting bracket 42 is attached to the top wall 24 (FIG. 3) of the freezer compartment and forms a member having a generally U-shaped cross section. The bracket 42 includes top mounting surfaces 43 which attach to the top wall 24. Side walls 44 extend downwardly along the sides of the ice maker 32. A bottom wall 46 joins the side walls 44 and forms a heat shield beneath the bottom of the ice maker 32. Downwardly directed tabs 48 depend from the top mounting surfaces 43. The ice maker 32 is attached to the mounting bracket 42 via mounting legs (not shown). An air baffle member 52 is connected to the back of the ice maker 32 and acts to direct the flow of air within the freezer compartment 16 across the ice mold 36 as will be further discussed hereinbelow.

The ice discharge assembly 34 is designed to prevent ice harvesting when the ice storage bin 28 is full of ice pieces. The need for this function is well recognized in the ice maker art. If ice harvesting is not appropriately controlled, the ice maker 32 may make an excessive quantity of ice and overfill the ice storage receptacle 28. In addition to limiting the quantity of ice produced, the ice discharge assembly 34 operates to control the discharge of ice pieces from the ice maker 32 such that ice pieces are not discharged when the freezer door 20 is open. If ice pieces are discharged when the door 20 is open, the ice pieces will fall onto the floor since the ice storage bin 28 is mounted on the door 20. To achieve these dual purposes, the ice discharge assembly 34 includes a front cover 62, a latching mechanism 64 and an ice level sensing mechanism 66 which operate together to achieve the above describe functions.

The ice stripper 38 includes a ramp 68 for directing harvested ice into the ice storage bin 28. The ramp 68 may be integrally formed with the ice stripper, as shown, or may be a separate member. The front cover 62 is pivotably supported by the tabs 48 in front of the ice maker 32. The front cover 62 is a generally flat member having a front surface **62*a* and a back surface 62*b*. The front cover includes a pair of support extensions 70 extending from the back surface 62*b* which are rotatably captured by the tabs 48 and allow the cover 62 to swing or pivot freely as long as the latching mechanism 64 is not engaged. The ramp 68 is angled downwardly and forwardly toward the back surface of the front cover 62. A bottom terminal edge 68*a* of the ramp 68 is disposed adjacent the back surface of the cover 62 wherein a small gap separates the bottom edge 68*a* and the back surface 62*b* of the cover 62**.

When ice pieces are ready to be harvested from the ice mold body 36, the ejector and stripper 38 cooperate to remove ice pieces from the mold body 36 and urge the harvested ice pieces to slide forwardly along the stripper 38. The ice pieces slide forward off the stripper 38 and are directed to slide down the ramp 68. The spacing between the back wall of the cover 62 and the bottom edge **68*a* of the ramp 68 is such that ice pieces are not able to fit through the elongated gap which separates the ramp 68 and the cover 62. Accordingly, ice pieces sliding down the ramp 68 make contact with the cover 62. However, the mass of the ice pieces and the slope of the ramp 68 is such that the ice pieces push the cover 62 forward upon contact, rotating the cover 62 about the tabs 48, wherein the ice pieces are able to fall into the storage bin 28**.

Figure 14:
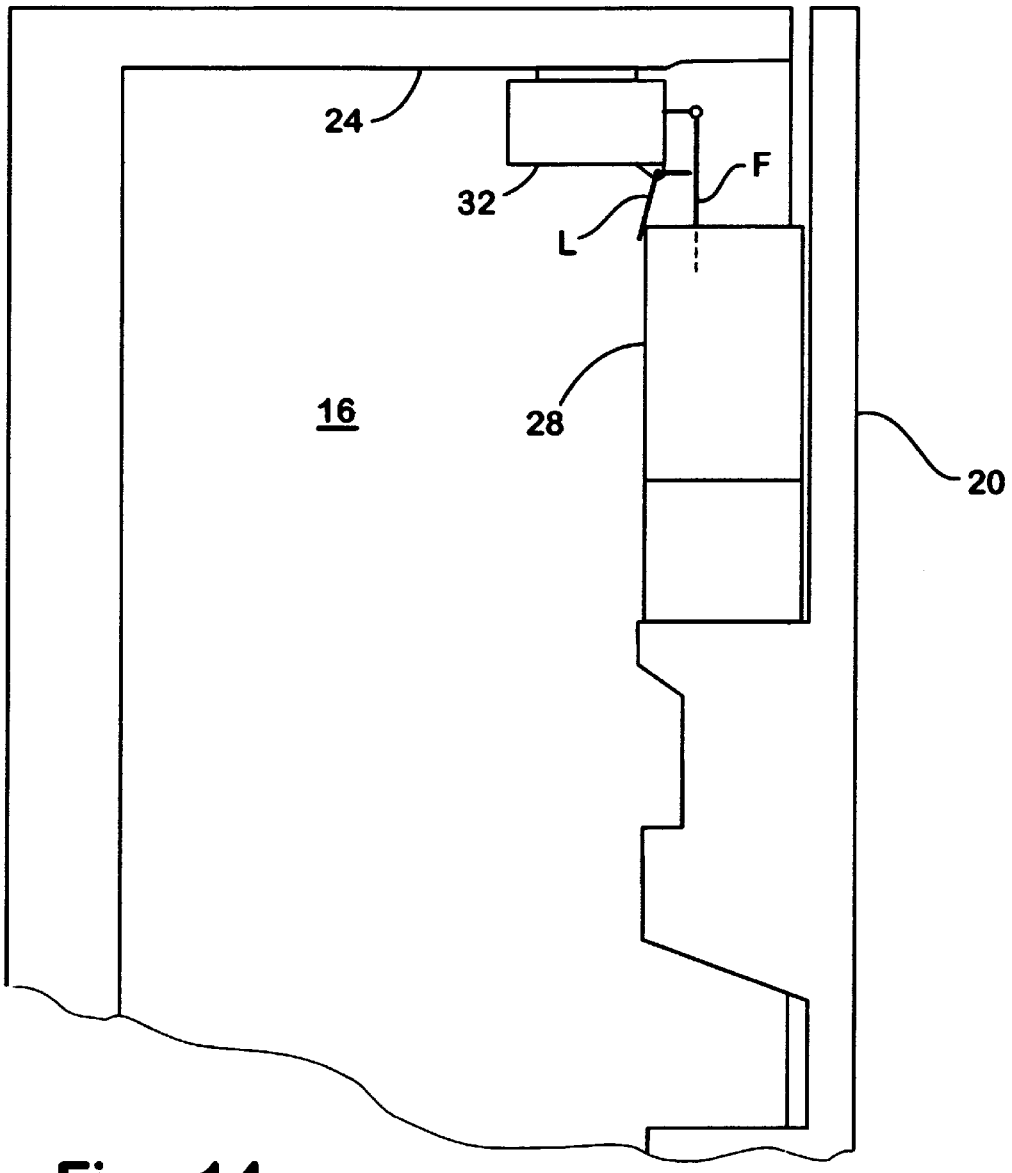
FIG. 14 is a simplified, fragmentary side sectional view of the ice storing and dispensing system of FIG. 1.

As mentioned above, the ice discharge assembly 34 serves to prevent overfilling of the ice storage receptacle by sensing the level of ice in the ice storage bin 28 and to prevent ice discharge when the door 20 is open. While the present written description describes two embodiments, both embodiments operate according to the same basic construction shown in FIG. 14. Both embodiments include an ice level sensing finger F which extends from the ice maker 32 into the ice storage bin 28. The finger F is periodically lifted up out of the bin and then lowered back into the bin 28 by the control module 40, as described herein below. The finger F can be a member which is rotatably or slidably supported above the ice storage bin 28. When the door 20 is opened, it is necessary to raise the finger F out of the bin 28. This is accomplished by a lever L pivotably mounted to the ice maker 32 and biased toward the door 20. When the door 20 opens, the lever L rotates, lifting the finger F out of the bin. The finger F can be a ramp, a wire member, a plastic member. The finger F can be configured to rotate about a horizontal axis or a vertical axis. Both embodiments further include a movable wall member M which is secured in a closed position when the door 20 is opened to prevent inadvertent ice discharge from the ice discharge assembly 34 when the door 20 is opened.

Figure 6:
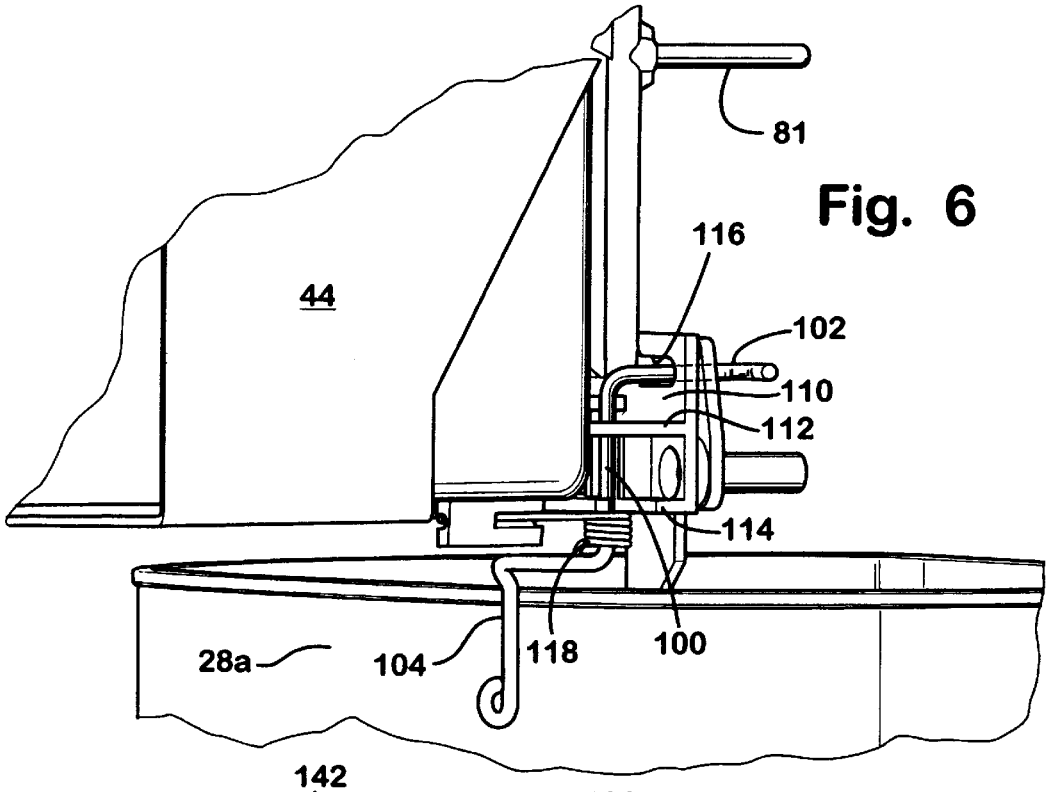
FIG. 6 is a fragmentary, enlarged perspective view of the first embodiment of the ice storage and dispensing system of the present invention wherein the front cover has been removed, illustrating the bin lever and associated components.

The first embodiment of the ice level sensing mechanism 66, shown in FIGS. 4, 5 and 6, operates to prevent overfilling of the bin 28. The ice level sensing mechanism 66 includes a shut-off arm 76 extending from the control module 40. The shut-off arm 76 is lifted by a cam located within the control module 40 prior to and during the harvesting of ice cubes. The actuation of the shut-off arm 76 is described in U.S. Pat. No. 5,160,094 which is herein incorporated by reference.

The shut-off arm 76 is connected to a sensing finger 78 through a connecting rod 80. The finger is connected to base 82 or alternatively, the base 82 and finger may be one integral part. The base 82 is pivotably supported by a pin 84. As shown, the connecting rod 80 is rotatably connected to the shut-off arm 76 and the base 82 to allow for rotational motion of the finger 78 about the pin 84. Thus, as the shut-off arm 76 is raised during the ice harvesting cycle, the finger 78 is pivotably raised out of the storage bin 28. Once the ice pieces are harvested and have fallen into the bin 28, the finger 78 is lowered back into the bin 28.

When a sufficient amount of ice pieces have been delivered to the ice storage bin 28 so as to cause the level therein to rise to a preselected full level, the operation of the ice maker 32 will be interrupted by preventing the shut-off arm 76 from returning to its normal position. This occurs when the finger 78 contacts ice pieces when it is lowered back into the ice storage bin 28 such that it is prevented from fully descending into the bin 28. The ice maker operation will be interrupted until such time as the level of ice pieces in the bin 28 is lowered as by removing some or all of the ice bodies therein. When this occurs, the finger 78 is allowed to fully descend into the bin 28 permitting the shut-off arm 76 to return to its normal position wherein the ice maker operation is resumed. A lever 81 extends from the connecting rod through the front cover 62 to allow a user to manually deenergize the ice maker 32 by lifting the shut-off arm 76 via the lever 81.

As can be readily appreciated from the above description, every time the freezer door 20 is opened, the ice storage bin 28, being mounted on the door 20, is removed from beneath the ice making assembly 22. Accordingly, it is necessary to completely lift the ice level sensing finger 78 out of the ice storage bin 28 when the freezer door 20 is opened. Failure to lift the finger 78 out of the bin 28 when the door 20 is open could result in damage to the finger 78 and to the entire ice level sensing system 66.

FIG. 6 in combination with FIGS. 5 and 6 illustrate the mechanism used to lift the finger 78 out of the bin 28 when the door 20 is opened. A bin lever 100 is rotatably supported adjacent the rear wall 28*a* of the bin 28. The bin lever 100 is preferably a wire member having an upper latching portion 102 and a lower bin engagement portion 104 joined by a center portion. As shown in FIG. 6, the bin lever 100 may be supported by a side extension portion 110 extending from the main body of the ramp 68. The bin lever 100 is snap fit into a pair of slotted openings provided on support walls 112 and 114 which extend from the side extension 110. The upper latching portion 102 extends forwardly through a guide slot 116 formed into the side extension 110. The guide slot 116 ensures the proper vertical orientation of the upper latching portion 102 of the bin lever 100. It should be noted that the bin lever 100 could be supported in other ways, such as by structure extending from the control module 40.

A spring 118 engages the bin lever 100 and biases it to rotate clockwise when viewed from above, as shown by arrow 120, such that the bin engagement portion 104 is biased toward the rear wall of the bin 28*a*. When the door 20 is closed, the rear wall 28*a* of the bin 28 engages the bin engagement portion 104 winding the spring 118 and causing the bin lever 100 to rotate counterclockwise, opposite of the arrow 120. However, when the door 20 is opened, the bin lever 100 is free to rotate clockwise until the latching portion 102 engages the base of the guide slot 116.

As described above, the finger 78 is connected to the base 82 and the base is pivotally supported about the pin 84. The pin 84 extends outwardly from the side extension 110. Accordingly, lowering and raising the finger 78 is accomplished by rotating the finger about the pin 84. The base has a ramp surface 86. The ramp surface 86 is positioned within the travel of the latching portion 102 of the bin lever 100. When the door 20 is closed, the bin lever is rotated to a position which allows the finger to descend into the bin 28. However, when the door 20 is opened, the clockwise rotation of the bin lever 100 causes the latching portion 102 to engage the ramp surface 86, rotating the finger 78 up out of the bin 28. In this manner, whenever the door 20 is opened the finger 78 is lifted completely clear of the bin 28. To further ensure that damage does not occur to the finger 78 when the freezer door 20 is opened, the finger 78 may be formed from flexible plastic or elastomeric material such that finger 78 will flex if forced into contact with the bin 28.

The lifting of the finger 78, caused by the sliding engagement between the ramp surface 86 and the latching portion 102, also lifts the connecting rod 80 and the shut-off arm 76 such that the ice maker 32 is deenergized, preventing ice harvesting when the door 20 is open, thereby preventing ice from falling from the ice discharge assembly 34 when the door 20 is open.

The latching mechanism 64 further provides a means for preventing ice from falling from the ice discharge assembly 34 when the door 20 is open. The latching mechanism 64 operates to secure the front cover 62 in a closed position when the door 20 is open. The front cover 62 includes a catch 88 which extends from the back surface 62*b*. The catch 88 is positioned adjacent the latching portion 102 of the bin lever 100. As described above, when the door 20 is opened, the bin lever 100 rotates clockwise, as shown by arrow 120. This rotation of the bin lever 100 causes the latching portion 102 to rotate into a position wherein the latching portion engages the catch 88 thereby preventing the cover 62 from pivoting about the tabs 48. Accordingly, whenever the door 20 is open, the bin lever 100 rotates to a position wherein the cover 62 is latched closed. When the cover 62 is latched closed, the gap between the back surface 62*b* and the bottom edge 68*a* of the ramp is insufficient for ice pieces to pass therebetween. Thus, any ice pieces which are on the ice stripper 38 or ramp 68 when the door 20 is opened are prevented from falling out of the ice discharge assembly 34 until the door 20 is again closed.

While the bin lever 100 is shown rotatably supported about a vertical axis, it can be readily understood that the bin lever could be rotatably supported about a horizontal axis. Moreover, the bin lever could be operated to lift an ice sensing finger which is slidably supported above the ice storage bin rather than an ice sensing finger which is rotatably supported.

Figure 7:
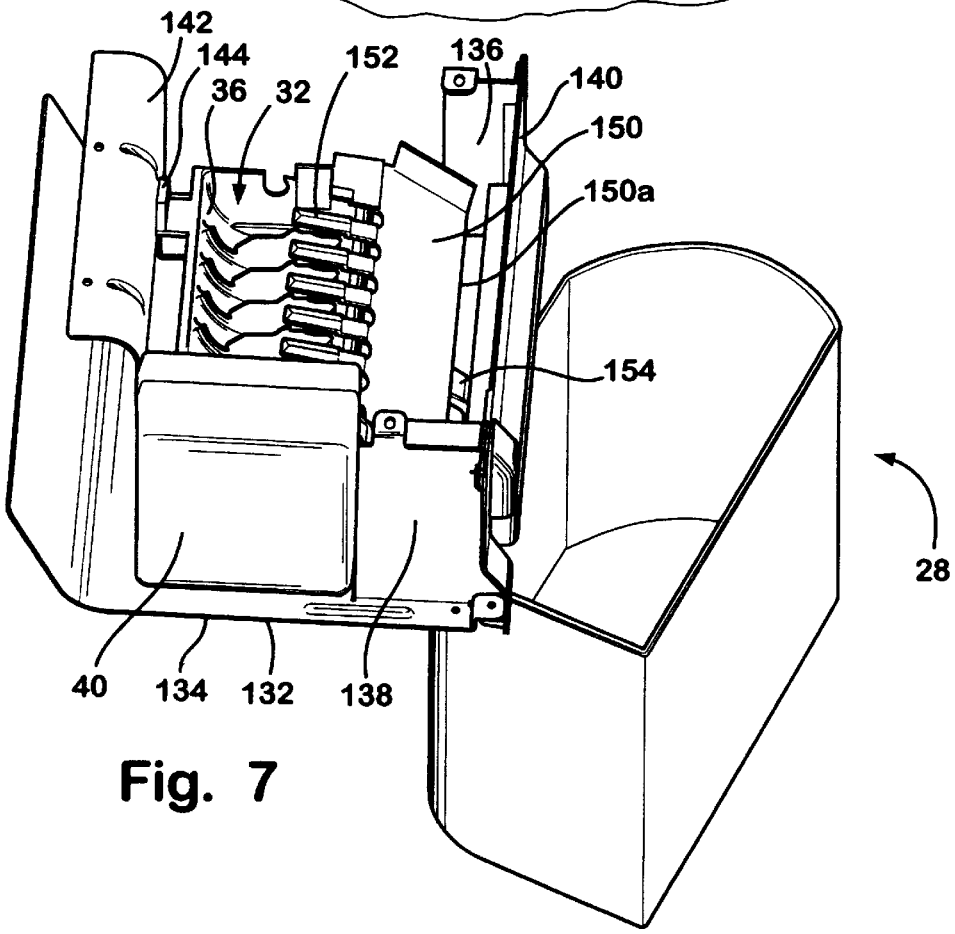
FIG. 7 is a fragmentary, perspective view of a second embodiment of the ice storage and dispensing system of the present invention, illustrating the freezer door partially open.
Figure 8:
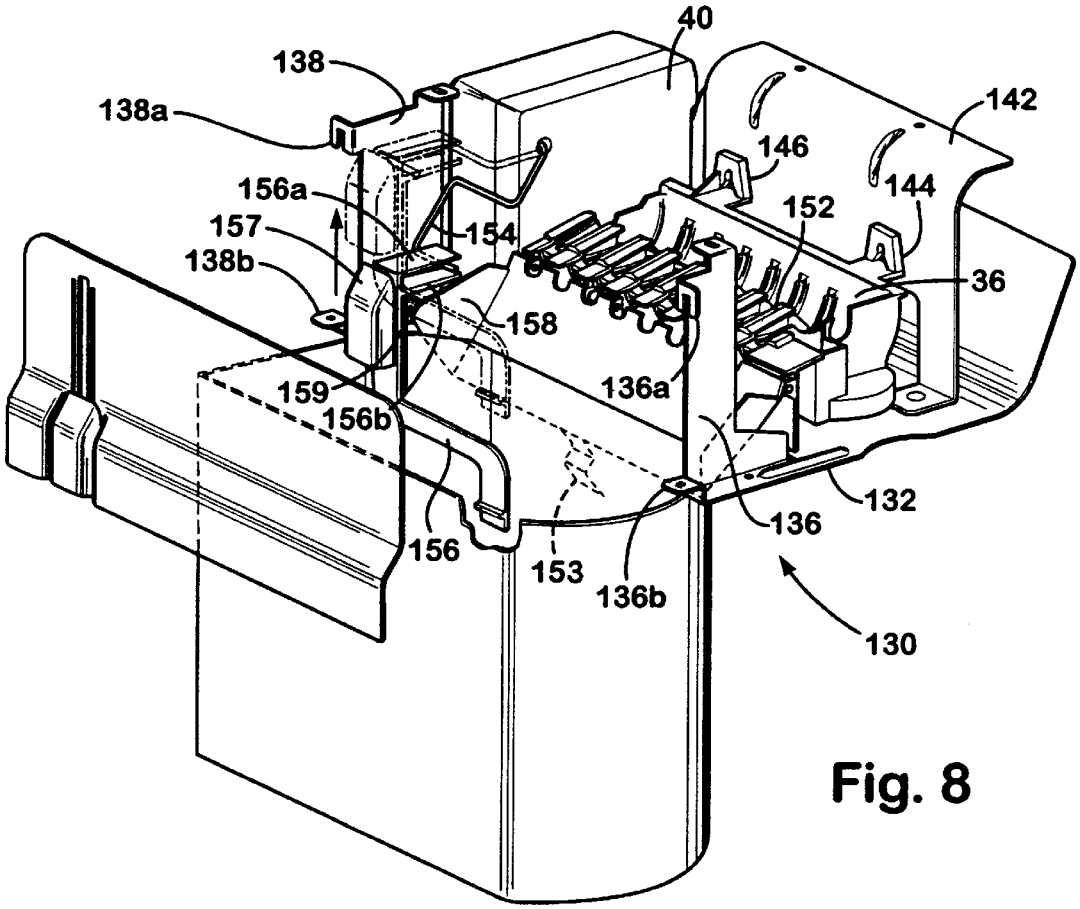
FIG. 8 is a fragmentary, perspective view of the second embodiment of the ice storage and dispensing system of the present invention wherein the front cover has been removed, illustrating the freezer door in a closed position.

FIGS. 7 and 8 disclose an alternative embodiment ice discharge assembly 130. In this embodiment, the ice maker 32, which is similar to the first embodiment, is supported by mounting bracket 132. The mounting bracket 132 includes a bottom shield portion 134 positioned below the ice maker 32. A pair of arms 136, 138 extend upwardly from the bottom shield portion toward the top wall 24 (FIG. 3) of the freezer compartment and provide means for rigidly mounting a front cover 140. As shown, the connection means for the front cover may include a pair of slotted tabs 136*a*, 138*a* and a pair of tabs 136*b*, 138*b*. A rear air deflector 142 also extends upwardly from the bottom shield portion 134. Both the arms 136, 138 and the rear air deflector 142 mount to the top wall 24 of the freezer compartment. The ice maker 32 is mounted to the rear air deflector 142 by a pair of mounting feet 144, 146.

A rotatable ramp 150 is connected to the ice maker 32 and may preferably be pivotably connected to an ice stripper 152. However, the ramp 150 may be pivotably connected to other ice maker components such as the ice mold. The ramp 150 is biased to rotate upwardly toward a horizontal position. The ramp 150 is preferably biased by a spring (not shown) which is between the ramp 150 and the ice maker 32. An arm portion 153 extends downwardly and outwardly from the ramp 150 and engages the ice storage bin 28 when the door 20 is closed. In this manner, as the door 20 is closed and the ice storage bin 28 is positioned beneath the ice making assembly 22, the bin 28 engages the arm 153 and rotates the ramp 150 approximately 70° into a downward position.

The ramp 150 includes a bottom terminal edge 150*a*. When the ramp 150 is rotated into its horizontal position, due to the door 20 being open, the terminal edge 150*a* is positioned adjacent the back of the front cover 140 such that any ice that is dispensed from the ice maker 32 is trapped between the ramp 150 and the front cover 140. In this manner, ice can not be discharged from the ice discharge assembly 130 when the door 20 is open. When the ramp 150 is rotated down, due to the door 20 being closed, the bottom edge 150*a* is moved away from the front cover 140 such that ice pieces can slide down the ramp 150 and fall into the ice storage bin 28.

In addition to preventing the discharge of ice when the freezer door 20 is open, the ice discharge assembly serves to prevent overfilling of the ice storage bin 28 by sensing the level of ice in the bin 28. To that end, a shut-off arm 154 is provided extending from the control module 40. The shut-off arm 154, similar to the shut-off arm 76, is lifted by a cam located within the control module 40 prior to and during the harvesting of ice cubes. The actuation of the shut-off arm 154 is described in U.S. Pat. No. 5,160,094 which was previously incorporated by reference.

The shut-off arm 154 is a wire member having a terminal portion which is drivingly connected to an ice sensing finger 156. In particular, the terminal portion of the shut-off arm 154 is disposed between a pair of horizontal walls 156*a*, 156*b* extending from the upper end of the ice sensing finger 156. The ice sensing finger 156 is slidingly supported by the front cover 140 for vertical movement and has a bottom portion which extends down into the ice storage bin 28. During ice harvesting from the ice maker 32, the shut-off arm 154 lifts the ice sensing finger 156 up out of the bin 28 and then lowers the finger 156 back into the bin. When a sufficient amount of ice pieces have been delivered to the storage bin 28 so as to cause the level therein to rise to a preselected full level, the operation of the ice maker 32 will be interrupted by preventing the shut-off arm 154 from returning to its normal position. In addition to deenergizing the ice maker in response to the ice level sensing operation, a knob 157 extends from the finger 156 through the front cover 140 to allow a user to manually deenergize the ice maker 32 by lifting the shut-off arm 154 via the knob 157.

The motion of the rotatable ramp 150 during the opening of the freezer door 20 also acts to lift the finger 156 out of the bin 28 when the door 20 is opened, thereby preventing damage to the finger 156. The ramp 150 includes a side wall 158 having a rod-like extension 159. The extension 159 is disposed beneath the wall 156*b* of the finger 156. Upon opening the door 20, the ramp 150 rotates upwardly wherein the extension 159 engages the wall 156*b* and raises the finger 156 and rotates the shut-off arm up from its normal position. In this manner, the ice maker 32 is deenergized, preventing ice harvesting when the door 20 is open and thereby preventing ice pieces from falling from the ice discharge assembly 130 when the freezer door 20 is open. To further ensure that damage does not occur to the finger 156 when the freezer door 20 is opened, the finger 156 may be formed from flexible plastic or elastomeric material such that finger 156 will flex if forced into contact with the bin 28.

Figure 12:
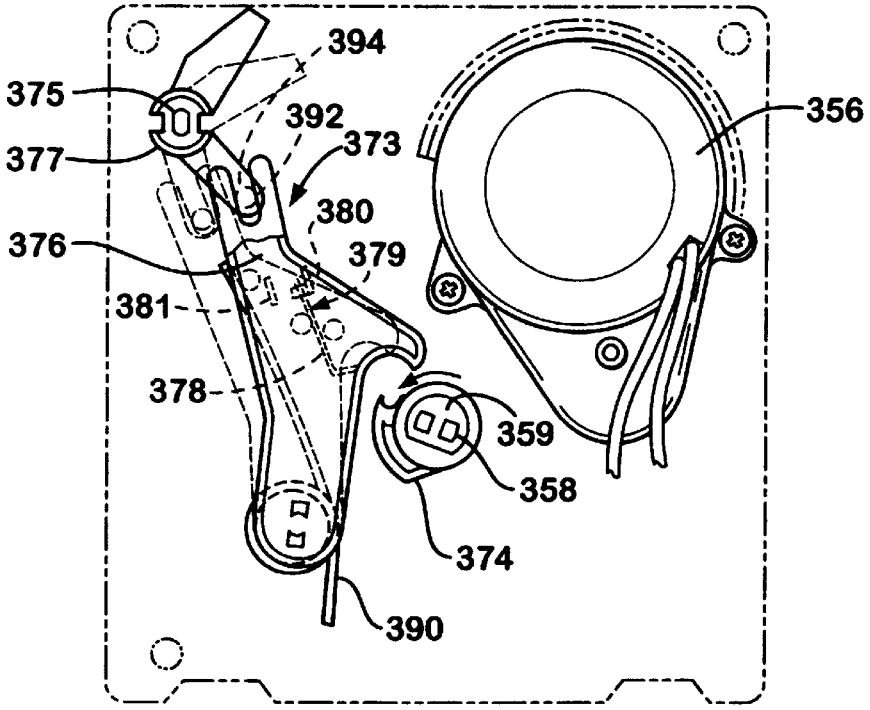
FIG. 12 is an enlarged partial perspective view of the control module of the ice making system of the present invention.
Figure 13:
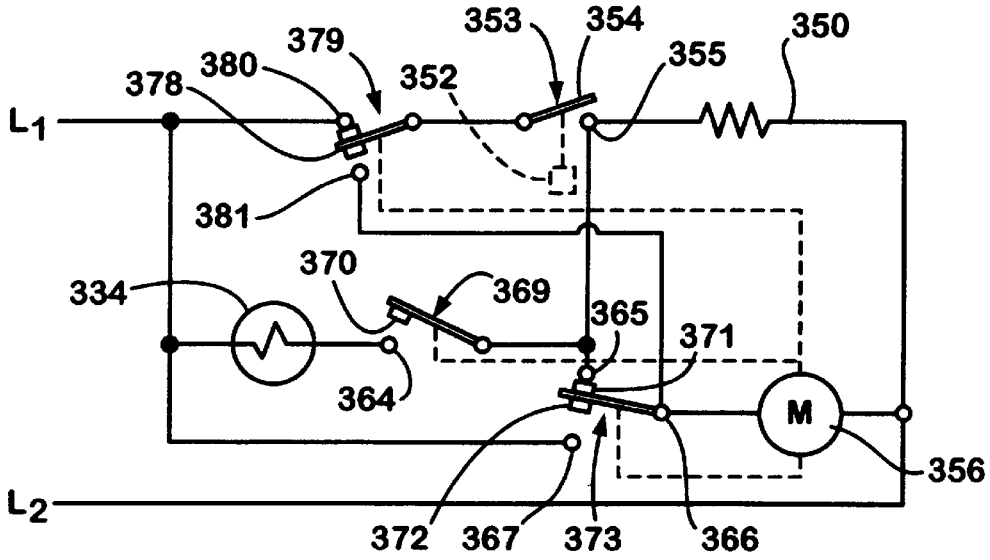
FIG. 13 is a schematic electrical wiring diagram illustrating the circuitry of the ice maker of the present invention.

Turning now to FIGS. 12 and 13, the operation of the control module 40 can be understood. The control module 40 is the same basic construction for both first and second embodiments. Assuming that the mold contains a quantity of water in the process of being frozen to form the ice pieces in the ice mold 36 and the level of the ice pieces in collecting bin 28 is below the pre-selected full level, a mold thermostat 352 senses a relatively warm condition whereby a switch 353 is in the open condition, as shown in FIG. 13. Further, a shut-off switch 379 has movable contact 378 in contact with fixed contact 380, a holding switch 373 has the movable contact 371 thereof in contact with the fixed contact 365 and the water valve switch 369 has its movable contact 370 spaced from its fixed contact 364. Thus, the control 40 is in a de-energized condition between power supply leads L1 and L2.

As described above, the thermostat 352 is arranged to have a cut-in temperature of 32° F. Thus, when the water in the mold cavity 36 becomes completely frozen and the temperature thereof drops to 17° F., the thermostat switch 353 is operated to close contact 354 with contact 355, thereby establishing a circuit from power supply lead L1 through contact 380 and 378 of switch 379, contacts 354 and 355 of switch 353, and through the heater 350 to Lead L2. At the same time, the control motor 356 is energized from contact 355 through contacts 365 and 371 of the holding switch 373. Rotation of the motor drives a cam surface to break contact between fixed contact 365 and 366, and the third cam surface path 372 makes contact between fixed contacts 366 and 367 thereby establishing a holding circuit from lead L1, through contacts 367 and 366 to motor 356 whereby the motor 356 is energized regardless of the condition of the thermostat switch 353.

The operation of the motor 356 causes rotation of the shaft 358 until the ejector blade (not shown) engages the ice bodies within the mold cavity 36 at approximately 54° of rotation. In the event the ice bodies have not been freed from the mold walls, the motor 356 stalls until such time as the mold heater 350 melts the ice bodies free. The motor then continues rotation of the ejector blade, to move the ice bodies from the cavities of the ice mold 36.

Beginning at approximately 180° rotation of the shaft 358 the cam surface 374 causes a lever arm 376 to pivot in a counterclockwise direction, see FIG. 12, thereby pivoting an actuator 377 clockwise. The actuator 377 is connected to the shut-off arm 76, 154 (depending on the embodiment). Thus pivoting the actuator 377 raises the shut-off arm 76, 154 and the sensing finger 78, 156 upwardly from the collecting bin 28. At the same time, the lever arm 376 breaks contact between moving contact 378 and the fixed contact 380 and after a suitable dead-zone makes an electrical contact between the movable contact 378 and the fixed contact 381.

This establishes a circuit to the heater 350 from the lead L1 through contacts 367 and 366 of the holding switch 373, contacts 381 and 378 of the shut-off switch 379 and contacts 354 and 355 of the thermostat switch 353. Thus, the control motor 356 is energized independently of the thermostat switch 353, while the heater 350 is energized under the control of the thermostat switch 353.

Between approximately 135° and 180° rotation of the ejector blade, the heater 350 will have heated the mold up sufficiently, i.e. 32° F., to reset the thermostat 352 and accordingly open the switch 353 by moving the movable contact 354 thereof away from the fixed contact 355, thus de-energizing the heater 350. This results in the heater 350 being de-energized while the ice bodies are still partially within or just removed from the mold 36. The mold 36 continues to heat up slightly due to heat dissipation from the heater 350, preventing the ice bodies from again freezing to the mold 36. However, the temperature of the mold should not exceed 40° F. As the holding switch 373 is arranged with fixed contacts 366 and 367 electrically connected, the control motor 356 continues to operate.

At approximately 288° of rotation, the electrical contact between fixed contacts 364 and 365 of water valve switch 369 is completed. Since switch 353 is now open, the solenoid 334 becomes energized to admit water through the inlet 332 to the mold 36 for forming a subsequent group of ice pieces. After a pre-selected period, for example, at 303° rotation, the water valve switch 369 opens breaking contact between fixed contacts 364 and 365, thereby terminating the flow of water to the mold 36.

At approximately 335° rotational position of the ejector blade, the lever arm 376 is pivoted by the cam 358 to rotate the shut-off arm 76, 154 into the collecting bin 28. If the level of ice pieces collected in the bin 28 is below a pre-selected level, then the sensing finger 78, 156 moves downwardly into the bin 28 and allows the lever arm 376 to pivot sufficiently to permit the movable contact 378 to become repositioned, as shown in FIG. 12, with the movable contact 378 spaced from the fixed contact 381 and now engaging the fixed contact 380.

The completion of the control cycle occurs upon small additional operation of the motor 356 breaking contact between the fixed contacts 366 and 367 to open the holding switch 373. The control 40 is now fully de-energized at the beginning of the operation cycle as discussed above, whereby a subsequent cycle will become initiated by the complete freezing of the ice bodies in the mold as discussed above.

When a sufficient number of ice bodies have been delivered to the collecting bin 28 so as to cause the level therein to rise to a pre-selected full level, the operation of the control 40 as discussed above will be interrupted by preventing the lever arm 376 from returning to the normal position shown in solid line in FIG. 12. Thus, the movable contact 378 remains in engagement with the fixed contact 381 and the circuit remains broken between the contacts 378 and 380. This condition will remain until such time as the level of ice bodies in the bin is lowered as by removing some or all of the ice bodies therein. When this occurs, the release of the sensing finger 78, 156 permits the return of the lever arm 376 to the position of FIG. 12, thereby allowing the switch 379 to close movable contact 378 with fixed contact 380 and permitting subsequent operation of the control 40, as discussed above.

Figure 15:
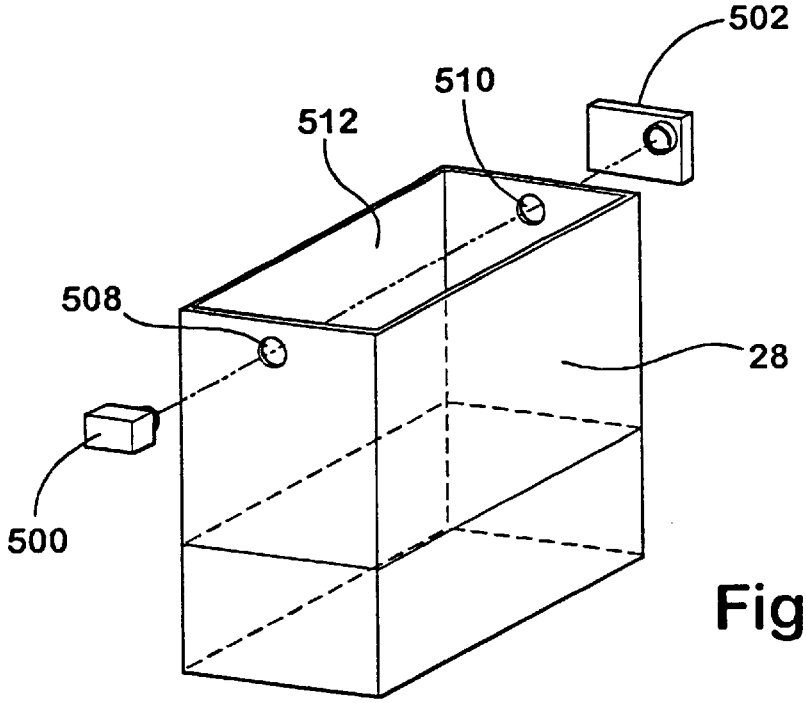
FIG. 15 is a simplified, elevational view of the ice storage bin and the optical ice level sensing system.
Figure 16:
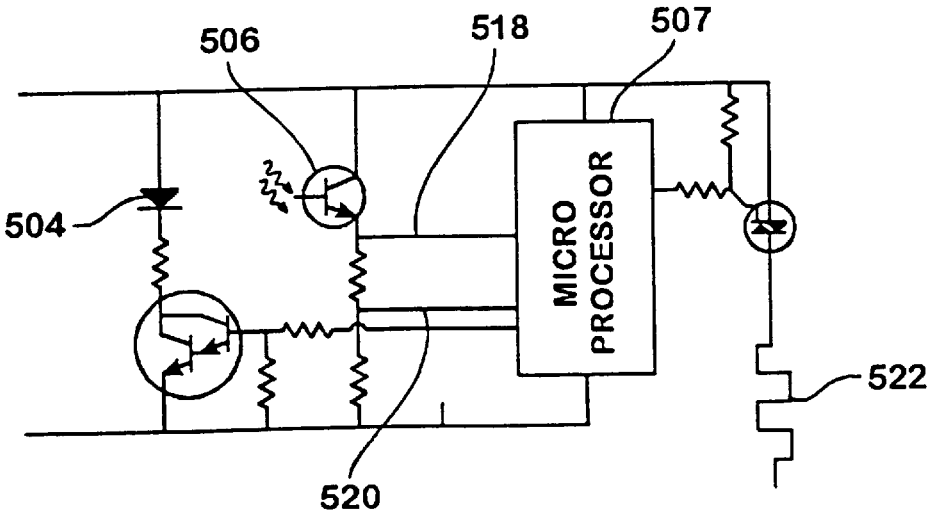
FIG. 16 is a schematic electrical diagram illustrating the circuitry of the optical ice level sensing system of FIG. 15.

In the ice discharge assembly 34 of the first embodiment, shown in FIGS. 4–6, and the ice discharge assembly 130 of the second embodiment, shown in FIGS. 7 and 8, the mechanical ice level sensing systems may be replaced by an electronic optical system as shown in FIGS. 15 and 16. In an optical ice level sensing system, light (electromagnetic radiation of any wavelength) is used to sense the presence of ice pieces. An optical ice level sensing system takes advantage of the fact that ice pieces formed by a conventional ice maker, as described above, have a cloudy core which is due to air bubble entrapment, crazing during the freezing process, and water impurities among other things. This cloudy core of the ice pieces blocks a wide range of wave lengths that are generated and sensed by many standard infrared (IR) radiation products.

As shown in FIGS. 15 and 16, an optical ice level sensing system includes a light emitter 500 and receiver 502. The emitter 500 may be a printed circuit board (PCB) having a IR photo diode 504 which emits an IR light while the receiver may be a photo transistor 506 mounted to a PCB along with a microprocessor 507 and the necessary electronic circuitry to operate the optical ice level sensing system. The microprocessor 507 controls the operation of the ice level sensing system. The emitter 500 may be mounted to a side wall of the freezer compartment 16 adjacent the top of the ice storage bin 28 while the receiver 502 is mounted to the side wall of the freezer compartment 16 opposite from the emitter. A pair of openings 508 and 510 are disposed in the ice storage bin 28 near the top surface of the bin 28 such that a line of sight or clear path 512 is created between the emitter and the receiver.

During operation of the optical system, IR radiation is generated by the emitter 500 which is directed to pass along the path 512 through the ice storage bin 28 to be received by the receiver 502. As discussed above, ice pieces, due to there cloudy core, will impede the transmission of the IR radiation such that the level of the level the IR signal received by the receiver can be used as an indicator of the ice level. When the IR photo diode 504 is pulsed, if the photo transistor 506 senses an IR signal, this indicates that the ice bin 28 is not completely filled with ice and the ice maker 32 will be operated to produce and harvest more ice pieces. If the photo transistor 506 does not sense an IR signal when the emitter 500 is pulsed, this indicated that the ice bin 28 is full of ice pieces and further ice will not be harvested.

One problem with an optical ice level sensing system is that ice can coat the photo diode 504 and the photo transistor 506 such that sending and receiving IR signals is impaired. The signal may be degraded to a point where the optical system provides a false full ice bin signal when in fact the ice storage bin is not full of ice pieces. This occurs particularly quickly when the refrigerator is operated in a hot and humid location wherein when the freezer door 20 is opened, moisture immediately condenses onto the cold surfaces within the freezer compartment 16.

This degradation can be sensed and distinguished from a normal situation as shown in FIG. 16. The microprocessor 507 receives signal 1 across line 518 and signal 2 across line 520. With clean optics, both signal 1 and 2 are read as a logic level "1" when the bin is empty and a logic level "0" when the bin is full. At some point during the degradation process, the lesser voltage at signal 2 will fall below the microprocessor input threshold and be read as a logic level "0" while the greater signal 1 is still large enough to be read as a logic level "1". Whenever signals 1 and 2 differ, ice build up has occurred and it is necessary to clean the optic system.

Heater resistors are shown as 522 which are used to clean the optics system. The heaters are physically located adjacent the photo transistor 506 and the photo diode 504. When optic cleaning is necessary, the heaters 522 are energized to warm the photo transistor 506 and the photo diode 504 such that the accumulated ice is melted away.

Turning now back to FIGS. 2 and 3, the ice dispensing system 26 can be further explained. The ice storage bin 28 is mounted to the freezer door and includes an upper ice bin member 160 and a lower ice bin member 162. The upper ice bin member 160 is formed from a clear plastic material such that the quantity of ice pieces stored within the ice bin 28 is easily visually determined. The lower ice bin member 162 is rigidly connected to the upper ice bin member 160 and includes a funnel wall portion 164, a cylindrical wall portion 166 and a bottom wall portion 168. The bottom wall portion 168 includes an ice outlet opening 170 through which the ice pieces must pass to be dispensed.

Rotatably supported within the ice bin 28 is an auger 172 having a shaped upper end 174 and a bottom shaft 176. The upper end 174 is supported within the upper ice bin member 160 and is designed to break up any large clumps of ice pieces which may be formed when ice pieces partially melt and then refreeze. Accordingly, to rotation of the auger 172 ensures that the ice pieces are free to move downwardly, under the urgings of gravity, through the lower ice bin member and the ice crushing system 30 such that ice pieces may be dispensed. The upper end 174 of the auger 172 is also configured to avoid pushing ice pieces up and over the rim of the upper ice bin member 160.

Figure 9:
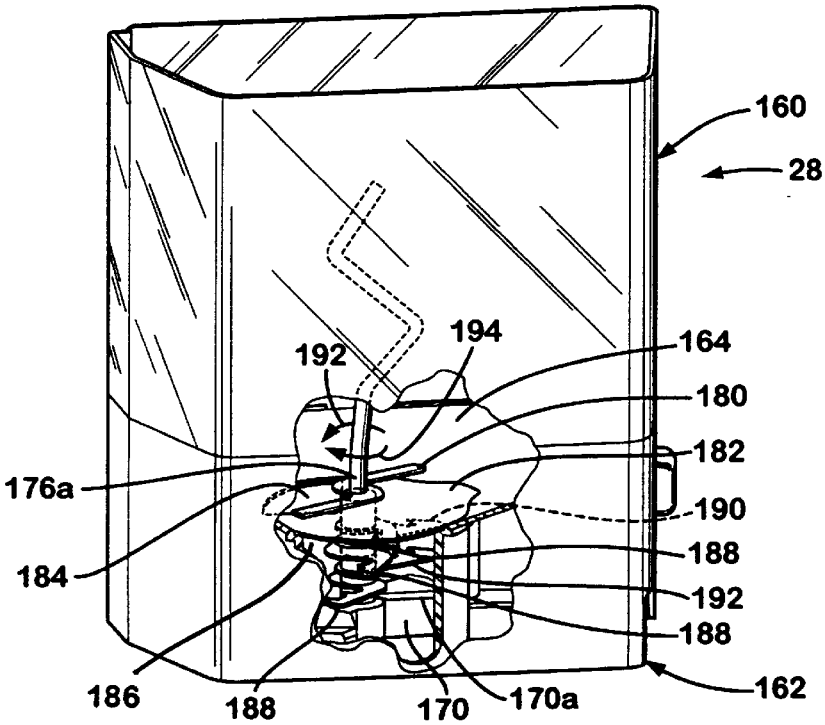
FIG. 9 is a fragmentary, enlarged, perspective view of the ice storage bin with a cut away portion illustrating the ice crusher assembly.

As best seen in FIGS. 3 and 9, the bottom shaft 176 of the auger 172 is disposed within the lower ice bin member. The bottom shaft 176 is provided with a flat surface such that various parts may be assembled to the shaft for co-rotation therewith. The upper end 176*a* of the bottom shaft 176 is positioned within the funnel wall portion 164 and the bottom end 176*b* of the bottom shaft 176 extends through the bottom wall for coupling to a drive shaft 178. The coupling between the drive shaft 178 and the bottom shaft 176 may be accomplished through use of a coupling member.

Drivingly connected to the upper end 176*a* of the bottom shaft 176 is a bridge breaker blade 180. The bridge breaker blade 180 rotates above a blade cover 182. The blade cover 182 is a plate which is attached to the lower ice bin member at the junction between the funnel wall portion 164 and the cylindrical wall portion 166. The cover 182, together with the funnel wall portion 164, forms a bottom wall of the upper ice bin member 160. An inlet opening 184 is formed into the cover 182 through which ice pieces must pass to be discharged. The inlet opening 184 is positioned 180° opposite of the outlet opening 170. As the auger 172 rotates, ice pieces are directed by the funnel wall portion 164 toward the inlet opening 184. The bridge breaker blade 180 ensures that the inlet opening 184 does not become jammed or bridged by ice pieces thereby preventing ice dispensing.

Once ice pieces pass through the inlet opening 184 they are disposed within a cylindrical ice crushing region 186 defined by the cylindrical wall portion 166, the cover 182 and the bottom wall portion 168. The bottom shaft 176 passes through the center of this region. Extending from the bottom shaft 176 are a plurality of ice crusher blades 188. The ice crusher blades 188 are connected to the bottom shaft for co-rotation therewith. A plurality of stationary blades 190 extend between the bottom shaft 176 and the cylindrical wall portion 166. The stationary blades 190 are positioned adjacent the side edge 170*a* of the ice outlet opening.

Rotation of the auger 172 causes the ice pieces to pass through the inlet opening 184 and fall into the ice crushing region 186. If the auger 172 is rotated counterclockwise, as shown by arrow 192, the ice pieces within the crushing region 186 are swept by the ice crushing blades 188 from the inlet opening 184 around within the crushing region 186 to fall through the outlet opening 170. The ice pieces move from the inlet opening 184 to the outlet opening 170 without having to pass through the stationary crusher blades. In this manner, when the auger 172 is rotated in the direction of arrow 192, whole ice pieces are dispensed though the outlet opening 170 and no ice crushing occurs.

If the auger 172 is rotated clockwise, as shown by arrow 194, the ice pieces within the crushing region 186 are swept by the ice crushing blades 188 from the inlet opening and are driven into the stationary ice crushing blades 190. The rotation of the auger 172 rotates the blades 188 past the stationary blades 190 resulting in the ice pieces being crushed. The crushed ice pieces, once past the stationary blades 190, fall through the outlet opening 170. In this manner, when the auger 172 is rotated in the direction of arrow 194, crushed ice pieces are dispensed though the outlet opening 170. Once the ice pieces, in either a whole or crushed form, are passed through the ice outlet opening 170, they fall through a chute 196 (FIG. 10) formed into the freezer door 20 to a waiting receptacle positioned within the service area 31.

While the dispensing of the ice pieces have been described with regard to the use of a plurality of crusher blades 188, the invention could readily be practiced with just one crusher blade 188 and one stationary blade 190. Moreover, the invention could dispense ice from the ice storage bin 28 without use of rotating and stationary crushing blades. For example, the rotary blades 188 and stationary blades 190 could be omitted and replaced with a paddle or other valving devices such as a pivotable or rotary door.

As just described, rotation of the auger 172 and the associated ice crusher blades 188 causes ice to be moved from the area of the upper ice bin member 160, through the ice inlet opening 184 and outlet opening 170 such that ice pieces are dispensed. The auger 172 is rotated by the drive shaft 178 which extends from a motor 200. The motor 200 is supported on the freezer door 20 below the ice service. The drive shaft 178 extends a relatively large distance between the motor and the ice bin 28.

To ensure proper operation of the ice delivery system of the present invention, it is important to rigidly and securely support the motor 200 and the ice bin 28 on the freezer door 20 since these parts must align for proper operation. The construction of the freezer door, as shown in FIG. 3, provides the necessary strength and rigidity. The freezer door 20 comprises a metallic outer wrapper 202, an inner liner 204 with a foam material 206 disposed between the wrapper 202 and the liner 204. The ice service area 31 is formed by a service housing 205 which attaches to an opening in the wrapper 202. The fabrication of the door 20 may be such that the foam material 206 is foamed in place between the wrapper 202, the liner 204 and service housing 205 and bonds to the inner surfaces of the wrapper 202, liner 204 and service housing 205 providing a great deal of strength and rigidity.

Figure 10:
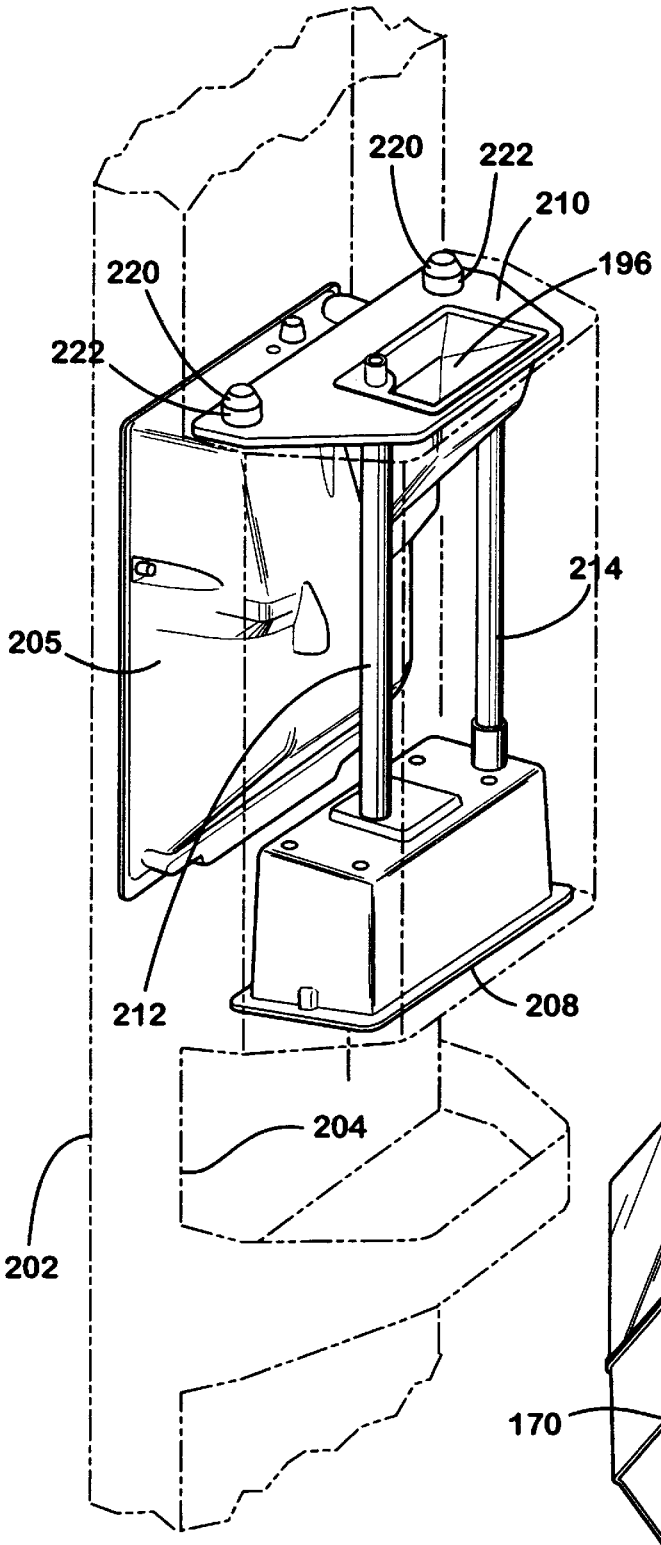
FIG. 10 is an enlarged, perspective view of the components of the ice storage and dispensing system of the present invention which are mounted to the freezer door wherein the freezer door liner, wrapper and insulation have been removed.

FIGS. 3 and 10 illustrate the components used to support the motor and the ice storage bin 28. The motor 200 is mounted to a bracket 207 within a cup-shaped support member or housing 208 which is connected to the inner liner 204 prior to the foaming operation. A motor cover plate 209 is placed over the open end of the housing 208 after the motor is assembled to the door. The ice bin 28 is mounted to a mounting plate 210 which is connected to the inner liner 204. A conduit 212 extends between the mounting plate 210 and the housing 208 through which the drive shaft 178 can extend. A wiring conduit 214 is also connected to the motor housing 208 and extends upwardly to connect to the housing 205. In this manner, wiring can be routed between the motor 20 and controls placed in the ice service area 31.

Accordingly, it can be understood that that during fabrication of the freezer door 20, the housing 208, the mounting plate 210, the conduit 212 and the wiring conduit 214 are assembled to the inner liner 204 and then the foam 206 is foamed between the liner 204 and the wrapper 202 such that the components are bonded into position. Moreover, it can be readily appreciated by one skilled in the art that the conduits 212 and 214 may be integrally formed as part of the mounting plate 210 or the housing 208. Likewise, the mounting plate 210 or the housing 208 may be able to be integrally formed as part of the service housing 205.

Figure 11:
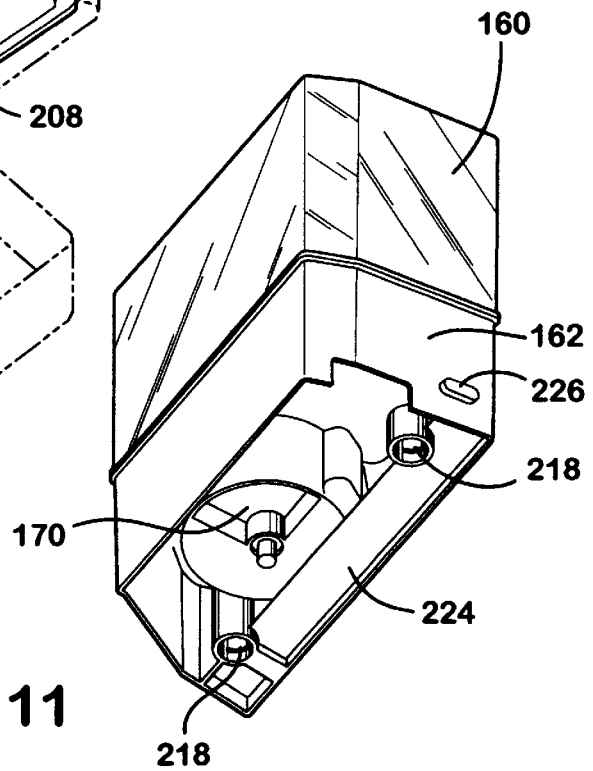
FIG. 11 is an enlarged, perspective view of the bottom of the ice storage bin of the ice storage and dispensing system of the present invention.

One of the benefits of the present invention is that the ice bin 28 is removable from the freezer door. This allows a user to readily remove the ice bin 28 and dump a large quantity of ice into a receptacle such as an insulated cooler. FIGS. 10 and 11 best show how this is accomplished. The lower ice bin member 162 is provided with a pair of cylindrical bosses 218 or receptacles which correspond to mounting pins 220 provided on the mounting plate 210. When the ice storage bin 28 is properly set upon the mounting plate 210, the receptacles 218 and pins 220 align. Moreover, when the bin 28 is properly placed on the plate 210, the drive shaft 178 is coupled with the auger 172 and the ice outlet 170 is disposed over the chute 196.

Means are provided for securing the bin 28 to the mounting plate 210. Each of the pins 220 are provided with an annular groove 222. A retention bar 224 is slidingly supported by the lower ice bin member 162. A button 226, connected to the bar 224, is provided for longitudinally moving the retention bar 224 which is biased toward the button 226. The retention bar 224 has a pair of cut out portions (not shown) corresponding to the grooves 222. When the bin 28 is placed onto the mounting plate 210, the pins 220 are received into the receptacles 218 and the cut out portions of the retention bar 224 are engaged into the grooves 222 provided on the pins 220. When it is desired to remove the bin 28, the button 226 is depressed such that the cut out portions of the retention bar 224 are disengaged from the grooves 222, allowing separation between the plate 210 and the bottom bin member 162.

While the retention means are shown in the present description as a retention bar and a pair of pins, the present invention is not limited to this structure. For example, only one pin could be used. Moreover, the retention means could be something other than a pin and bar such as a hook and latch arrangement.

It can be seen, therefore, that the present invention provides a unique ice making and storage system for a refrigerator wherein the ice maker is mounted to the top wall of the freezer and the ice storage bin is mounted on the freezer door. A novel method of delivering the ice from the ice maker to the ice storage bin is disclosed along with a novel way for ensuring that the proper amount of ice is formed.

While the present invention has been described with reference the above described embodiment, those of skill in the Art will recognize that changes may be made thereto without departing from the scope of the invention as set forth in the appended claims.

We claim:

1. A refrigerator including a freezer compartment having an access opening and a closure member for closing the access opening, the refrigerator comprising:

an ice maker being disposed within the freezer compartment for forming ice pieces;

an ice storage bin mounted to the closure member below the ice maker for receiving ice from the ice maker;

an ice level sensing finger extending from the ice maker into the ice storage bin for sensing the level of ice within the storage bin;

a lever pivotably connected to the ice maker and biased toward the closure member for lifting the ice level sensing finger out of the ice storage bin when the closure member is opened; and a movable wall positioned adjacent the ice maker such that ice pieces must pass by the movable wall to be discharged from the ice maker to the ice storage bin and wherein the movable wall is positioned in a closed position when the closure member is opened such that ice pieces can not be discharged when the closure member is opened.

2. The refrigerator according to claim 1, further wherein:

the ice level sensing finger is rotatably supported and extends into the ice storage bin;

the lever includes a bin lever rotatably mounted to the ice maker adjacent the ice level sensing finger having an end contacting the ice storage bin when the closure member is closed, the bin lever being biased toward the ice storage bin such that when the closure member is opened, the bin lever rotates and contacts the ice level sensing finger to raise the end of the finger out of the ice storage bin.

3. The refrigerator according to claim 2, wherein the ice level sensing finger has a ramp surface opposite the sensing end wherein the bin lever engages the ramp surface to rotate the sensing finger out of the ice storage bin when the door is opened.

4. The refrigerator according to claim 2, further comprising:

a spring for biasing the bin lever toward the ice storage bin such that the spring is wound when the door is closed.

5. The refrigerator according to claim 2 further comprising:

a pin extending outwardly from the ice maker;

the ice level sensing finger having a base which is rotatably connected to the pin such that the ice level sensing finger is rotatable about the pin such that the sensing end is rotatable into the ice storage bin, the base having a ramp surface; and the bin lever is rotatably connected to the ice maker and has a portion disposed adjacent the ramp surface such that when the door is opened the bin lever rotates and contacts the ramp surface rotating the ice level sensing finger about the pin and raising the sensing end of the finger out of the ice storage bin.

6. The refrigerator according to claim 2, further comprising:

a bracket mounted to the freezer top wall; and a front cover pivotably supported by the bracket in front of the ice maker wherein the bin lever rotates to latch the front cover when the closure member is opened.

7. The refrigerator according to claim 2, wherein the movable wall further comprises:

a front cover rotatably supported in front of the ice maker wherein the bin lever rotates to engage the front cover when the closure member is opened.

8. A refrigerator including a cabinet for defining a freezer compartment having top wall and an access opening, the refrigerator comprising:

a door for closing the access opening;

an ice maker being disposed within the freezer compartment adjacent the top wall for forming ice pieces;

an ice storage bin removably mounted to the door below the ice maker for receiving ice pieces from the ice maker;

an ice level sensing finger movably mounted adjacent the ice maker and having a sensing end extending into the ice storage bin;

a ramp rotatably mounted to the ice maker adjacent the ice storage bin, the ramp being biased to rotated toward the ice storage bin such that when the door is opened the ramp rotates and contacts the ice level sensing finger to raise the sensing end of the finger out of the ice storage bin.

9. The refrigerator according to claim 8, further comprising:

a front cover mounted in front of the ice maker wherein the ramp rotates to engage the front cover when the closure member is opened.

10. The refrigerator according to claim 8, further wherein the ice level sensing finger is slidably supported adjacent the ice maker for linear movement into and out of the ice storage bin.

11. A refrigerator including a cabinet for defining a freezer compartment having an access opening, the refrigerator comprising:

a door for closing the access opening;

an ice maker being disposed within the freezer compartment for forming ice pieces, the ice maker including an ice mold and a stripper member;

an ice storage bin mounted to the door below the ice maker for receiving ice from the ice maker;

a front cover supported in front of the ice maker;

a rotatable ramp extending from the ice maker for directing ice pieces into the ice storage bin; and a spring for biasing the ramp toward the door such that when the door is opened, the ramp rotates toward the front cover thereby preventing ice piece from sliding off the ramp when the door is opened.

12. The refrigerator according to claim 11, further comprising:

an ice level sensing finger slidably mounted to the front cover adjacent the ice maker, the ice level sensing finger having a sensing end extending into the ice storage bin and a lift surface, wherein when the door is opened, the ramp rotates toward the front cover and contacts the lift surface for lifting the sensing end out of the ice storage bin.

13. The refrigerator according to claim 11 wherein the ramp is rotatably connected to the ice stripper.

14. The refrigerator according to claim 11 wherein the ramp has an arm extending toward the freezer door when the freezer door is open and wherein the arm contacts the freezer door when the door is closed.

15. A refrigerator including a cabinet for defining a freezer compartment having a top wall and an access opening, the refrigerator comprising:

a door for closing the access opening;

an ice maker being disposed within the freezer compartment adjacent the top wall for forming ice pieces;

an ice storage bin mounted to the door below the ice maker for receiving ice from the ice maker;

a bracket mounted to the top wall;

a front cover pivotably supported from the bracket in front of the ice maker; and a bin lever rotatably mounted adjacent the ice maker and having an end contacting the ice storage bin when the door is closed, the bin lever being biased toward the ice storage bin such that when the door is opened, the bin lever rotates to engage the front cover thereby securing the front cover from pivoting and preventing ice piece from falling past the front cover when the door is opened.

16. The refrigerator according to claim 15, further comprising:

a ramp extending from the ice maker for directing ice pieces into the ice storage bin, the ramp having a terminal edge disposed adjacent the front cover such that when the front cover is engaged by the bin lever ice pieces can not slide off the ramp past the front cover.

17. The refrigerator according to claim 15, further comprising:

an ice level sensing finger rotatably mounted adjacent the ice maker and having a sensing end extending into the ice storage bin, wherein when the door is opened, the bin lever rotates and contacts the ice level sensing finger to raise the end of the finger out of the ice storage bin.

18. The refrigerator according to claim 15 further comprising:

a spring for biasing the bin lever toward the ice storage bin such that the spring is wound when the door is closed.

19. The refrigerator according to claim 15 further comprising:

a pin extending outwardly from the ice maker;

the ice level sensing finger having a base which is rotatably connected to the pin such that the ice level sensing finger is rotatable about the pin such that the sensing end is rotatable into the ice storage bin, the base having a ramp surface; and the bin lever is rotatably connected to the ice maker and has a portion disposed adjacent the ramp surface such that when the door is opened the bin lever rotates and contacts the ramp surface rotating the ice level sensing finger about the pin and raising the sensing end of the finger out of the ice storage bin.

20. A refrigerator including a cabinet for defining a freezer compartment having an access opening, the refrigerator comprising:

a closure member for closing the freezer compartment access opening, the closure member being hingedly connected to the cabinet;

an ice maker disposed within the freezer compartment for making ice pieces;

an ice storage bin mounted to the door below the ice maker for receiving ice pieces from the ice maker;

movable wall means for preventing ice pieces from falling from the ice maker when the closure member is opened; and movable probe means for sensing the level of ice pieces within the ice storage bin extending from the ice maker into ice storage bin.

21. The refrigerator according to claim 20 further wherein the ice maker an ice mold and means for harvesting ice pieces from the ice mold.

22. The refrigerator according to claim 21, further comprising:

means for deenergizing the harvesting means when the closure member is open.

23. The refrigerator according to claim 21, further wherein the means for sensing the level of ice pieces within the storage bin includes a ice level sensing arm extending down into the ice storage bin and further includes means for moving the ice level sensing arm up out of the ice storage bin when the closure member is opened.

* * * * *